US009225108B1

(12) United States Patent
Poff

(10) Patent No.: US 9,225,108 B1
(45) Date of Patent: Dec. 29, 2015

(54) HANDLE ASSEMBLY FOR AN ELECTRICAL CONNECTOR PLUG ASSEMBLY

(71) Applicant: Martin Design & Fabrication, Inc., Byron Center, MI (US)

(72) Inventor: Timothy M. Poff, Byron Center, MI (US)

(73) Assignee: Martin Design & Fabrication, Inc., Byron Center, MI (US)

( * ) Notice: Subject to any disclaimer, the term of this patent is extended or adjusted under 35 U.S.C. 154(b) by 0 days.

(21) Appl. No.: 14/626,954

(22) Filed: Feb. 20, 2015

(51) Int. Cl.
*H01R 13/58* (2006.01)
*H01R 13/633* (2006.01)

(52) U.S. Cl.
CPC ..... *H01R 13/5825* (2013.01); *H01R 13/6335* (2013.01)

(58) Field of Classification Search
CPC ..... H01R 13/5825; H01R 13/6335; Y10S 439/906
See application file for complete search history.

(56) References Cited

U.S. PATENT DOCUMENTS 5,162,000 A * 11/1992 Frantz ..... 439/607.58
5,836,784 A * 11/1998 De Oliveira et al. ..... 439/502
7,163,424 B2 * 1/2007 Dancel et al. ..... 439/731
7,419,399 B2 * 9/2008 Yosler ..... 439/358
7,896,690 B1 * 3/2011 Hsu et al. ..... 439/502
2005/0079749 A1 * 4/2005 Schmidt et al. ..... 439/275
2008/0280467 A1 * 11/2008 Tsuji ..... 439/135
2009/0233485 A1 * 9/2009 van Woensel ..... 439/607.34
2010/0330837 A1 * 12/2010 Wegener ..... 439/456
2012/0238130 A1 * 9/2012 Osawa et al. ..... 439/460
2012/0238131 A1 * 9/2012 Osawa ..... 439/476.1

* cited by examiner

*Primary Examiner* — James Harvey
(74) *Attorney, Agent, or Firm* — The Watson I.P. Group, PLC; Jovan N. Jovanovic; Vladan M. Vasiljevic

(57) ABSTRACT

A handle assembly that can be coupled to an electrical connector plug assembly. In an aspect of the disclosure, the disclosure is directed to a handle assembly for a connector plug. The plug comprises an arm member and a gripping assembly. The arm member defines a plug engagement structure toward the first end and a gripper engagement structure toward the second end. The plug engagement structure is structurally configured to couple to an electrical connector plug assembly. The gripping assembly includes an outer surface and defining an enclosure structurally configured to facilitate the passing of at least one conductor extending from a connector plug. The second end of the arm member extends into the enclosure of the gripping assembly. The gripper engagement structure engages an inner surface of the gripping assembly. The handle assembly can be used in combination with an electrical connector plug assembly.

16 Claims, 11 Drawing Sheets

HANDLE ASSEMBLY FOR AN ELECTRICAL CONNECTOR PLUG ASSEMBLY

CROSS-REFERENCE TO RELATED APPLICATION

N/A

BACKGROUND OF THE DISCLOSURE

1. Field of the Disclosure

The invention relates in general to electrical connectors and the handling of electrical connectors, and more particularly, to a handle assembly for an electrical connector plug assembly.

2. Background Art

The use of connectors is known in the art. In industrial settings, there are a number of different connectors that are utilized to charge different devices. For example, in the battery charging systems (and often seen in the fast charging systems), connectors such as those that fall into the DIN 43589-1 specification are commonly utilized to fast charge battery systems for different equipment, such as fork lifts and the like.

One such system that is commonly utilized is termed an Euro Battery Connector (EBC) and sold by Anderson Power Products of Sterling, Mass. under the trademark A Series EBC, and one such model is the A320 EBC, the specification of which is hereby incorporated by reference in its entirety. Such connectors, and other connectors of similar specifications, are utilized in charging circuits of vehicles wherein the connectors are connected and disconnected through many cycles each week.

Problematically, users often disconnect the connectors or move the connectors after initial separation by grasping and pulling the conductors. Over time, the conductor insulation may be compromised. Once compromised, the conductors are exposed, and, are prone to creating an electrical short, or, worse, shocking the user who inadvertently grasps the exposed conductors.

While grasping the body of the connector would be less likely to cause wear and failure of the insulation around the conductors, typically, the users and operators grasp the conductor due to the easier access and larger length of the conductor.

SUMMARY OF THE DISCLOSURE

The disclosure is directed to providing a handle assembly that can be coupled to an electrical connector plug assembly. In an aspect of the disclosure, the disclosure is directed to a handle assembly for a connector plug. The plug comprises an arm member and a gripping assembly. The arm member includes a first end and a second end. The arm member defines a plug engagement structure toward the first end and a gripper engagement structure toward the second end. The plug engagement structure is structurally configured to couple to an electrical connector plug assembly. The gripping assembly has a first end and a second end. The gripping assembly includes an outer surface and defining an enclosure structurally configured to facilitate the passing of at least one conductor extending from a connector plug. The second end of the arm member extends into the enclosure of the gripping assembly. The gripper engagement structure engages an inner surface of the gripping assembly, with the arm member coupled to the gripping assembly.

In some configurations, the gripping assembly further including a upper gripping portion and a lower gripping portion which are joined together to define a seam therebetween. The arm member is coupled to at least one of the lower gripping portion and the upper gripping portion through at least one fastener.

In some configurations, the arm member includes a top surface and a bottom surface. The top surface extends along an inner surface of the upper gripping portion, and is spaced apart from a base portion of the inner surface of the lower gripping portion.

In some configurations, the lower gripping portion includes at least one spacing tab extending from the base portion of the inner surface of the lower gripping portion and abutting the bottom surface of the arm member. The at least one conductor passes between the bottom surface of the arm member and the base portion of the inner surface of the lower gripping portion.

In some configurations, the gripper engagement structure comprises a proximal slot portion and a distal slot portion. Each is spaced apart from the other along the arm member. The inner surface of the upper gripping portion includes a corresponding proximal protruding tab and a distal protruding tab. The proximal protruding tab shape matingly engaging the proximal slot portion and the distal protruding tab shape matingly engaging the distal slot portion to, in turn, locate the arm member relative to the upper gripping portion.

In some configurations, the upper gripping portion includes an opening positioned on the proximal protruding tab and an opening positioned on the distal protruding tab. The lower gripping portion includes a proximal elongated bore extending from the inner surface, and a distal elongated bore extending from the inner surface. The proximal elongated bore corresponds to the opening positioned on the proximal protruding tab. The distal elongated bore corresponds to the opening positioned on the distal protruding tab upon positioning the upper gripping portion and the lower gripping portion in a joining orientation.

In some configurations, the proximal elongated bore extends to the inner surface of the upper gripping portion. The distal elongated bore extends to the inner surface of the upper gripping portion. Such a configuration isolates a fastener extending therethrough from access from within the enclosure defined by the upper and lower gripping portions.

In some configurations, the upper and lower gripping portions define an enclosure. Access to the enclosure is provided at a first end and a second end and precluded therebetween.

In some configurations, each of the upper gripping portion and the lower gripping portion defining an opening at the second end thereof. Additionally, each include a transverse slot portion at the second end thereof. A distal end gasket spans the opening and extends in the transverse slot portion of the upper and lower gripping portions. The distal end gasket has at least one conductor opening extending therethrough which is configured to receive a conductor passing from the first end through the second end of the gripping assembly.

In some configurations, the upper gripping portion includes a first side wall portion and a second side wall portion. Each sidewall portion extends between the first end and the second end, and each matingly engages to form a seam therebetween.

In some configurations, the first and second sidewall portions are spaced apart a greater distance from each other at a first end thereof than at a second end thereof.

In some configurations, the upper gripping portion and the lower gripping portion each include an outer surface with each outer surface being a substantial mirror image of the other.

In some configurations, the arm member comprises an elongated member having a substantially uniform thickness between the first end and the second end.

In some configurations, the plug engagement structure comprises a plurality of openings extending through the arm member proximate the first end thereof.

In another aspect of the disclosure, the disclosure is directed to a combination electrical connector plug assembly and handle assembly for the connector plug. The electrical connector plug assembly comprising a housing and a lever arm. The housing includes a proximal end and a distal end, a top surface, a bottom surface and a first and second side. A conductor inlet is at the distal end and a conductor outlet at the proximal end, each configured to receive a conductor extending therethrough. The lever arm engaging plate is coupled to a top surface of the housing. The lever arm engaging plate includes a central body and opposing spaced apart fingers that extend over a respective one of the first side and second side.

The handle assembly comprises an arm member and a gripping assembly. The arm member has a first end and a second end. The arm member defines a plug engagement structure toward a first end and a gripper engagement structure toward the second end. The first end overlies the lever arm engaging plate with the plug engagement structure coupled thereto. The gripping assembly has a first end and a second end. The gripping assembly includes an outer surface and defines an enclosure structurally configured to facilitate the passing of at least one conductor extending from a connector plug. The second end of the arm member extends into the enclosure of the gripping assembly. The gripper engagement structure engages an inner surface thereof, with the arm member coupled to the gripping assembly. The gripping assembly defines a first opening at a first end thereof. The first opening substantially corresponds to the inlet of the housing and is positioned proximate thereto.

In some configurations, the gripping assembly defines a second opening at a second end thereof. The first and second openings are defined in planes that are substantially parallel to each other, and generally corresponding to each other and to the conductor inlet and the conductor outlet of the housing.

In some configurations, the arm member is of a substantially uniform thickness. The arm member extends generally parallel to the central body of the lever arm engaging plate and the top surface of the housing.

In some configurations, the gripping assembly includes an upper gripping portion and a lower gripping portion which are coupled together. The upper gripping portion extends over and engages a top surface of the arm member. The lower gripping portion extends over and engages a bottom surface of the arm member.

In some configurations, the combination may further include including a hanger bracket attachable to an outside surface. The hanger bracket has a base with spaced apart forks extending outwardly therefrom, to, in turn, define a slot therebetween. The gripping assembly includes a plurality of nubs extending from an outer surface thereof, to, in turn, interface the spaced apart forks to maintain the gripping assembly and the hanger bracket in releasable engagement.

BRIEF DESCRIPTION OF THE DRAWINGS

The disclosure will now be described with reference to the drawings wherein.

DETAILED DESCRIPTION OF THE DISCLOSURE

Figure 1:
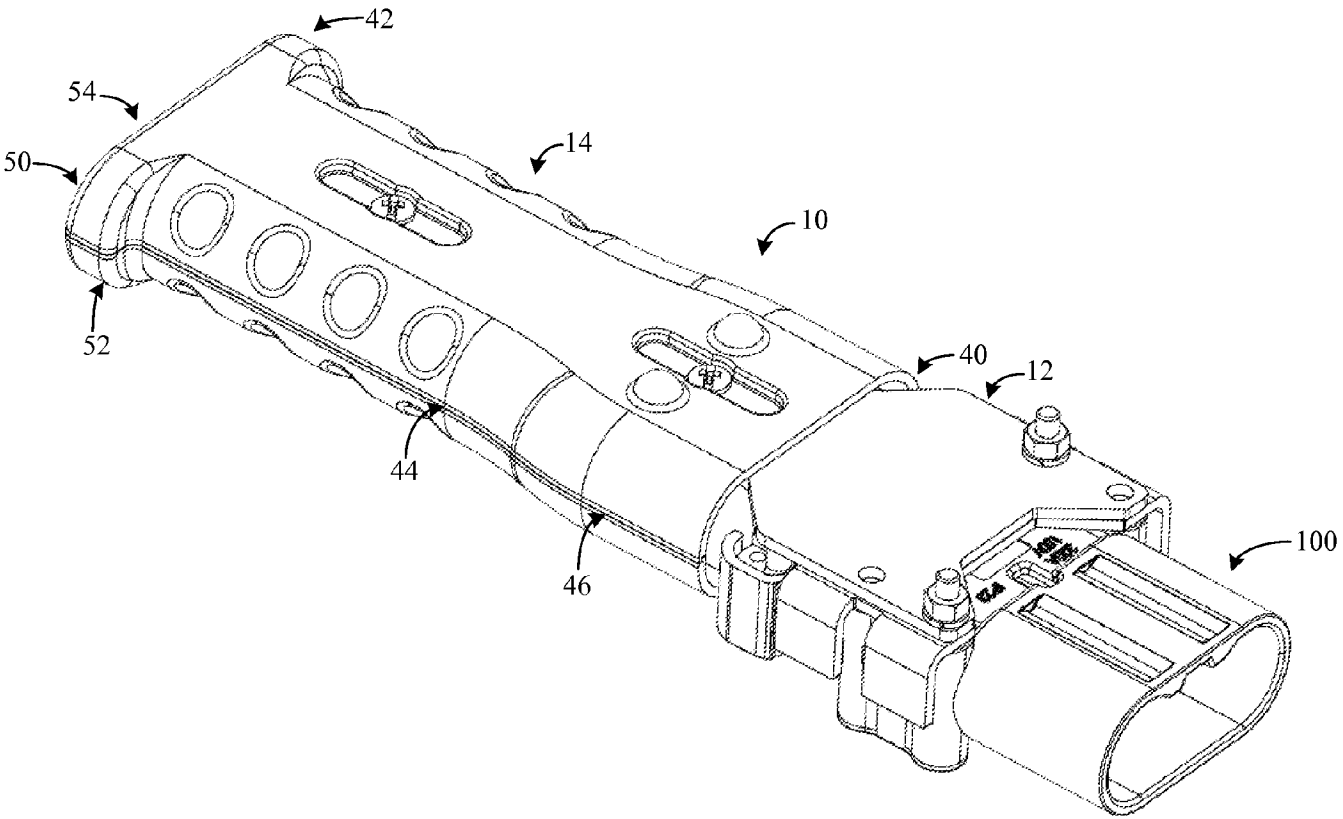
FIG. 1 of the drawings is a perspective view of an electrical connector plug assembly having a handle assembly of the present disclosure.

While this invention is susceptible of embodiment in many different forms, there is shown in the drawings and described herein in detail a specific embodiment with the understanding that the present disclosure is to be considered as an exemplification and is not intended to be limited to the embodiment illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Figure 2:
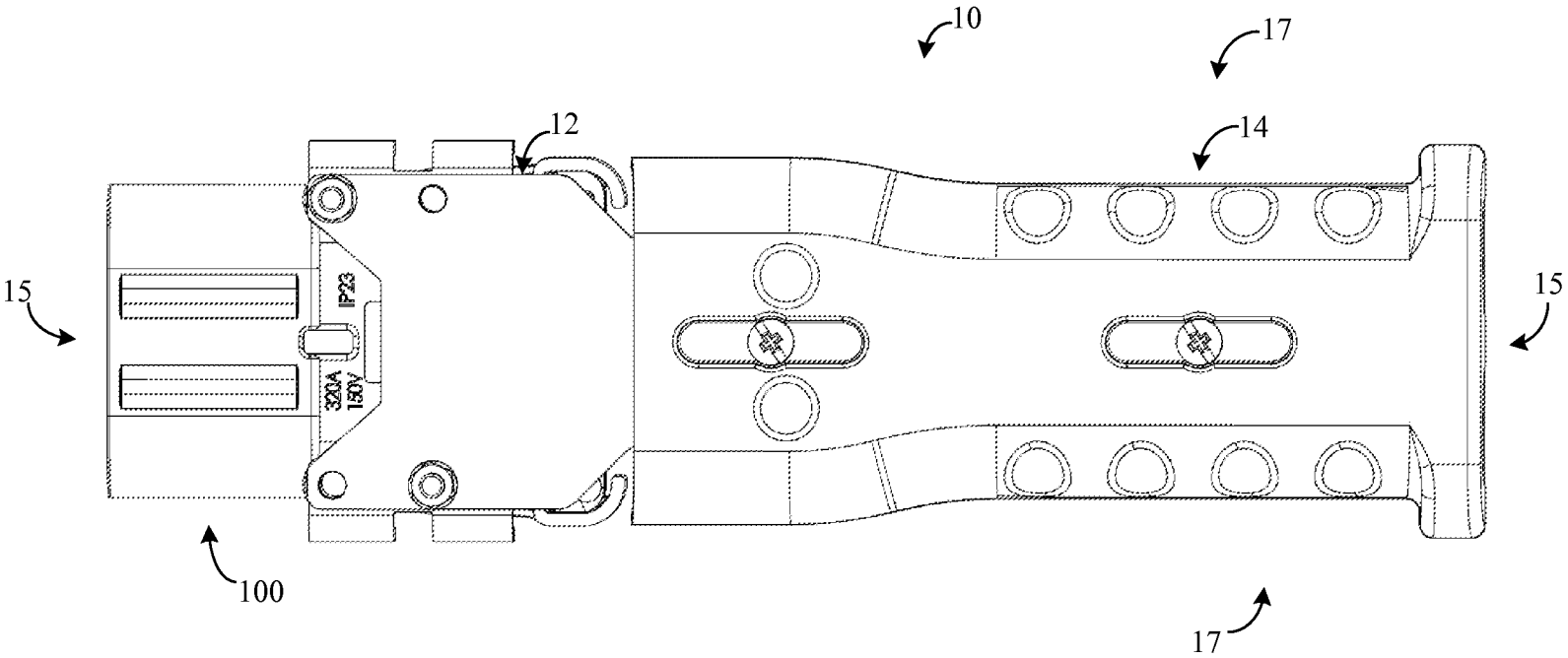
FIG. 2 of the drawings is a top plan view of an electrical connector plug assembly having the handle assembly of the present disclosure.
Figure 3:
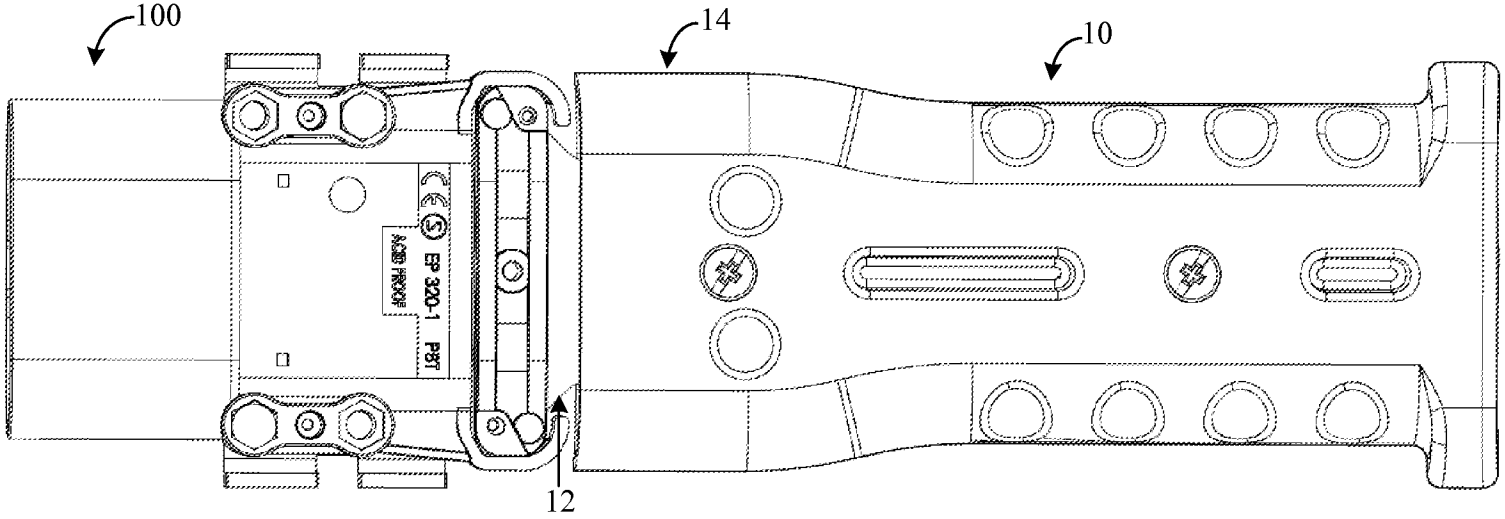
FIG. 3 of the drawings is a bottom plan view of an electrical connector plug assembly having the handle assembly of the present disclosure.

Referring now to the drawings and in particular to FIGS. 1 through 3, the handle assembly for an electrical connector plug assembly is shown generally at 10. The electrical connector plug is shown generally at 100. The electrical plug is typically utilized for coupling a power source to a circuit. The connector shown is offered by Anderson Power Products of Sterling, Mass. under the model number A320 EBC. The connector 100 includes a A320 male pin housing and battery bracket part number 993G4 (as well as cable clamps and contact holders, part numbers E320-7 S1, E320-6A S1, and E320-5S1), the specification of each of the foregoing is incorporated by reference herein. Such connectors are used in a number of different industries, including, but not limited to, the automotive industry for the coupling of different electrical circuits to power sources.

Such a connector is typically associated with a female socket housing which is coupled to a charger/truck bracket, part number 994G4, the specification of which is likewise incorporated by reference herein. In such an embodiment, the male pin housing is placed in the proper orientation. Subsequently, the lever of the charger/truck bracket is rotated, and the male pin housing connector is brought into contact (and electrical communication) with a female pin housing. As set forth above, such connectors are often handled by the lead wires, which are not of suitable strength for handling on a repeated basis. As a result, damage to the lead wires has resulted, which, in turn, results in events of electrocution and/or shorting of the wiring. In either instance, damage is caused. It will be understood that the handle assembly can be utilized with other connectors, and other EBC connectors, provided by Anderson Power Products, or others. The use of the E320 connector is for exemplary purposes and is not to be deemed limiting.

Figure 4:
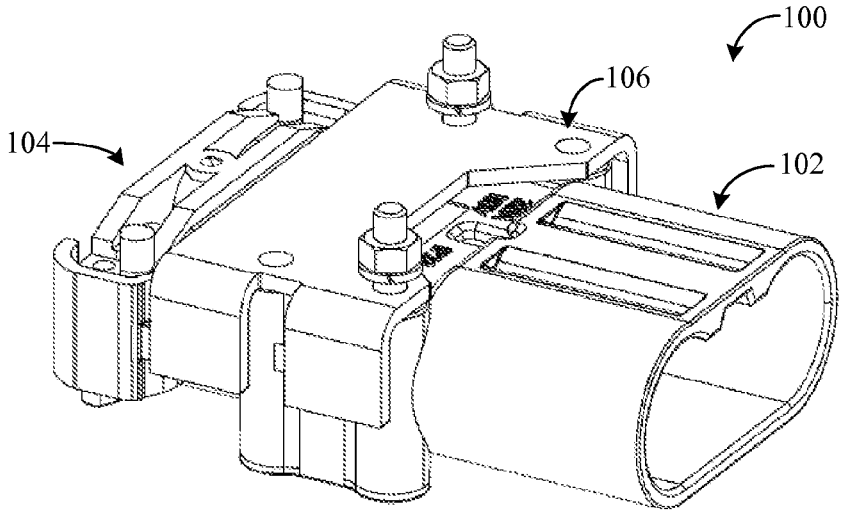
FIG. 4 of the drawings is a front perspective view of an electrical connector plug assembly for use in association with the handle assembly of the present disclosure.
Figure 5:
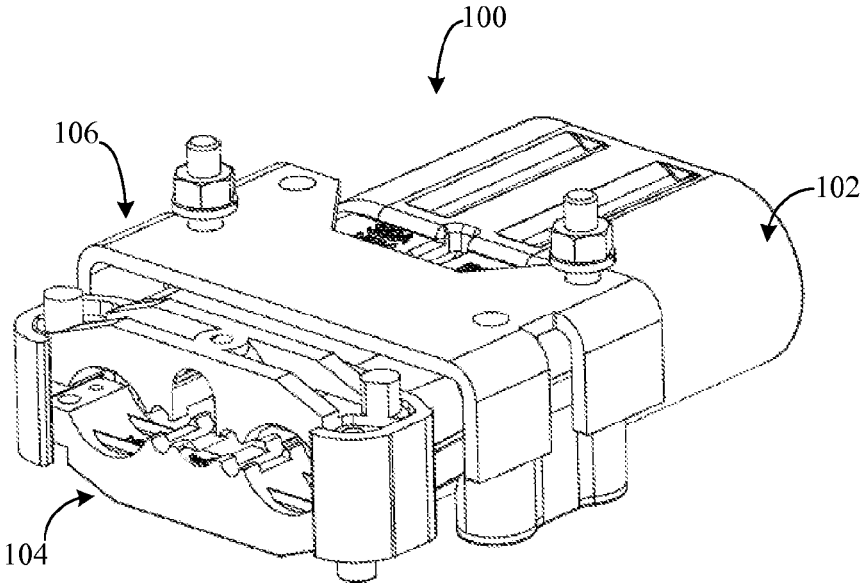
FIG. 5 of the drawings is a back perspective view of an electrical connector plug assembly for use in association with the handle assembly of the present disclosure.

With reference to FIGS. 4 and 5, the electrical connector plug assembly 100 includes housing 102, conductor clamp member 104 and lever arm engaging plate 106. A number of different embodiments are contemplated, however, a common configuration utilized in the industry is shown. The housing 102 generally comprises a molded member formed from an insulative material, such as a polymer or composite material.

Figure 6:
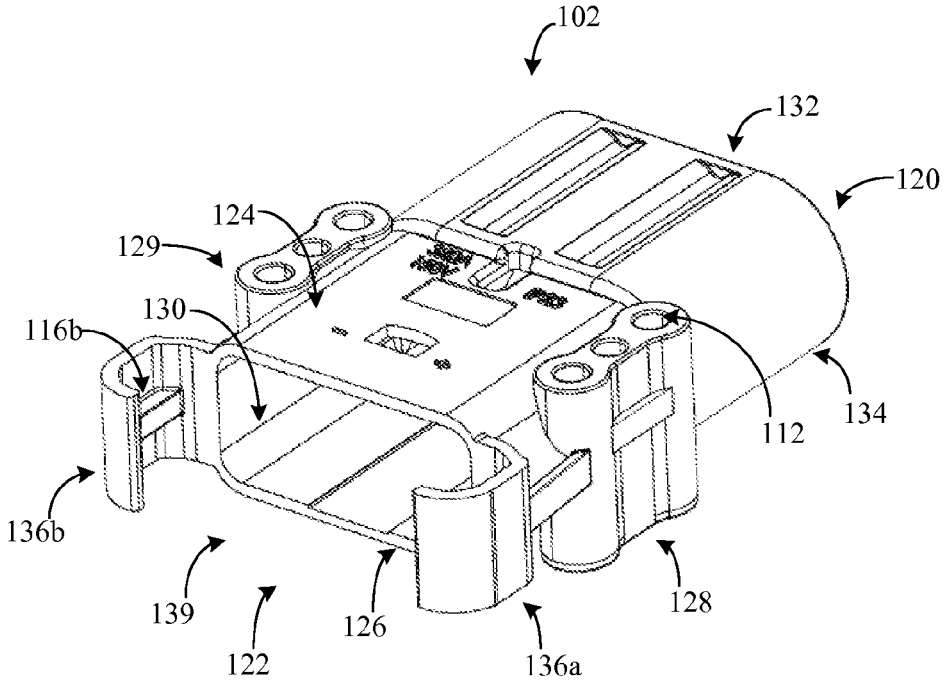
FIG. 6 of the drawings is a perspective view of the housing of the electrical connector plug assembly for use in association with the handle assembly of the present disclosure.
Figure 7:
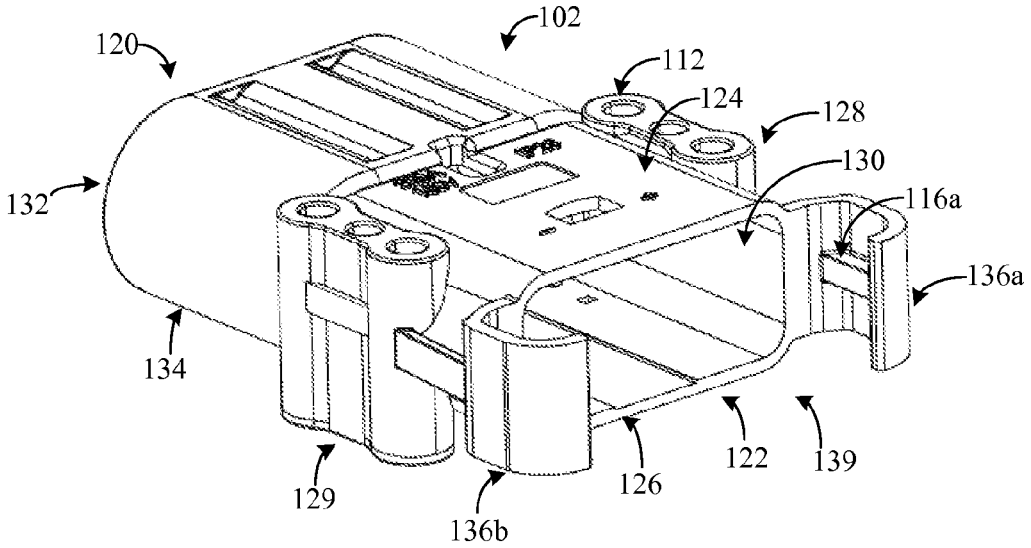
FIG. 7 of the drawings is a perspective view of the housing of the electrical connector plug assembly for use in association with the handle assembly of the present disclosure.

With further reference to FIGS. 6 and 7, the housing is defined by proximal end 120, distal end 122, top surface 124, bottom surface 126, first side surface 128 and second side surface 129. It will be understood that a pair of conductors extend longitudinally through the housing. In turn, the housing includes conductor inlet 130 and conductor outlet 132. A protective coupling sleeve 134 extends around the conductor outlet (which is configured to matingly engage with the corresponding connector). It will be understood that the shape of the protective coupling sleeve may be varied depending on the application, and, a typical shape is shown in the drawings. The protective coupling sleeve 134 defines an inner cavity 137 which houses the connector ends for coupling (often referred to as the male pin housing). It will also be understood that the configuration is not limited to male conductor ends, and that the connector of the electrical connector plug assembly may comprise a female connector configuration. Again, the housing is exemplary, and it will be understood that a female connector plug may be provided (which is then coupled to a male connector plug).

At the opposite end of the housing, namely, the distal end 122 of the housing, the housing defines a pair of opposing transverse arms 136*a*, 136*b*. The transverse arms include stop members which comprise inwardly protruding tabs positioned between the top surface and the bottom surface. It will be understood that these interface with the conductor clamp member 104. The opposing transverse arms 136*a*, 136*b* define clamp retaining channel 139.

Additionally, the first side 128 and the second side 129 each include coupling bores, such as coupling bore 112, that extends generally from the top surface 124 to the bottom surface 126, generally perpendicular to the top surface. These bores are configured and positioned so as to receive fasteners for the retention of outside objects and structures, such as, for example, the arm member 12 of the handle assembly 10, or the lever arm engaging plate 106.

Figure 8:
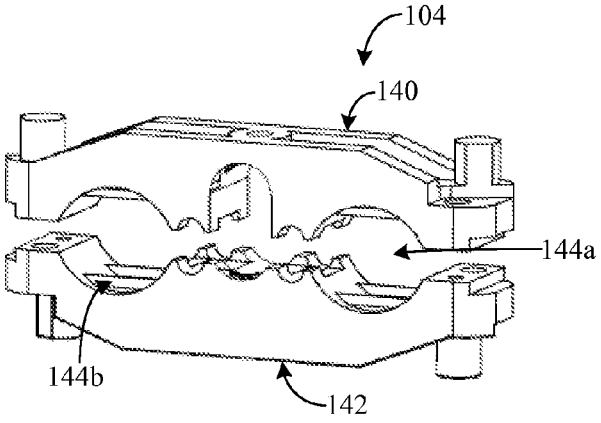
FIG. 8 of the drawings is a perspective view of the conductor clamp member of the electrical connector plug assembly for use in association with the handle assembly of the present disclosure.

With reference to FIG. 8 (and in conjunction with FIGS. 4 and 5 for the assembly) the conductor clamp member 104 includes upper portion 140 and lower portion 142. The upper and lower portions matingly engage to form conductor openings 144*a*, 144*b*. The upper portion extends between the opposing transverse arms 136*a*, 136*b* and from the top surface to the opposing stop members 116*a*, 116*b*. Similarly, the lower portion extends between the opposing transverse arms 136*a*, 136*b* and from the bottom surface to the opposing stop members 116*a*, 116*b*. The stop members preclude further upward movement of the lower portion and further downward movement of the upper portion. Suitable fasteners may extend through the bores found on either side of the upper and lower portions. In such a manner, the upper and lower portions sandwich the stopper members therebetween, and, additionally, sandwich the conductor within the conductor openings 144*a*, 144*b*. Thus, upward and downward movement of the assembled conductor clamp 104 is precluded by the stop members. Additional fasteners may be extended between the upper and lower portions so as to facilitate the clamping of the conductor thereby. Typically, the conductor clamp member 104 comprises a resilient, yet flexible member, such as a flexible polymer. In other embodiments, the material may be of increased rigidity. It is preferred that the conductor clamp member be formed from an insulative member. One exemplary clamp is offered as the 320 A cable clamp, top and the 320 A cable clamp, bottom from Anderson Power Products of Sterling, Mass., the specification of which is incorporated herein by reference.

Figure 9:
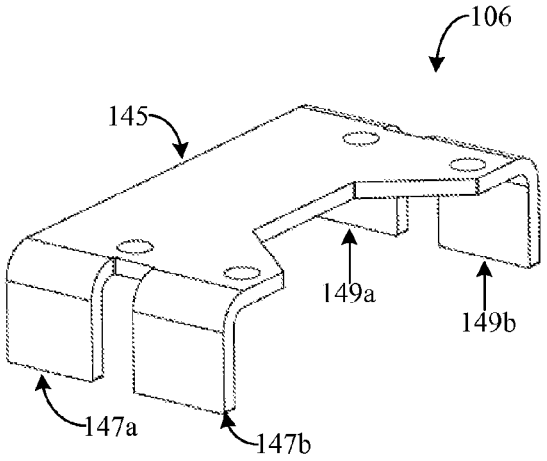
FIG. 9 of the drawings is a perspective view of the lever arm engaging plate of the electrical connector plug assembly for use in association with the handle assembly of the present disclosure.
Figure 14:
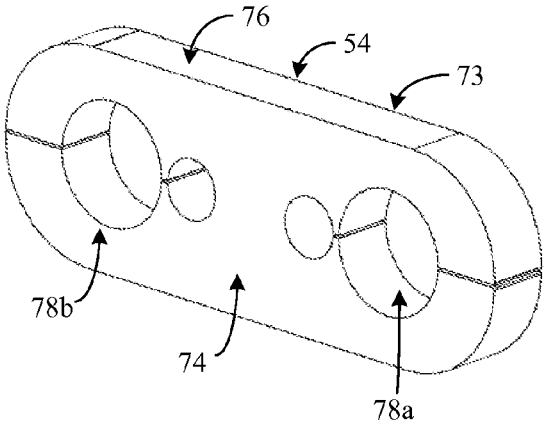
FIG. 14 of the drawings is perspective view of the distal end gasket of the gripping assembly of the handle assembly of the present disclosure.

With reference to FIG. 9 (and in conjunction with FIGS. 4 and 5 for the assembly) the lever arm engaging plate 106 includes central body 145, first side spaced apart fingers 147*a*, 147*b*, and second side spaced apart fingers 149*a*, 149*b*. In the embodiment shown, the lever arm engaging plate comprises a metal member of adequate strength characteristics. In particular, the lever arm engaging plate is configured to form the contact member upon which the lever arm system of the connector acts. More particularly, a tab on either side of the lever arm interfaces with the space between the first and second side spaced apart fingers so that rotation of the lever imparts largely forward or backward movement of the connector plug toward or away from the corresponding mating plug. Thus, the lever arm engaging plate is configured to have the necessary strength for bearing such a load. The spaced apart fingers 147*a*, 147*b*, 149*a*, 149*b* engage corresponding structures on the lever arm assembly. One exemplary clamp is offered as the battery bracket part number 993G4 from Anderson Power Products of Sterling, Mass., the specification of which is incorporated herein by reference.

In the embodiment shown, the lever arm engaging plate is formed from a single metal plate member with the spaced apart fingers being formed through a bending or stamping operation. The central body comprises a generally substantially planar member which is positioned so as to overlie the top surface 124 of the housing 102. In the configuration shown, the central body includes a plurality of openings which, when properly positioned, match up with the coupling bores 112 of the housing 102 of the electrical connector plug assembly. The opposing first and second side spaced apart fingers extend downwardly toward the bottom surface along the respective ones of the first side 128 and the second side 129. Additionally, in the embodiment shown, the lever arm engaging plate is positioned over the body between the opposing transverse arms and the protective coupling sleeve.

Conventionally, such an embodiment of the electrical connector plug assembly is provided. Typically, users grasp the conductors exiting from the housing 102 through the conductor openings 144*a*, 144*b*. Such repeated grasping of the conductors themselves tends to cause premature wear and stress on the conductor (and typically the insulation thereof) proximate the connections with the housing 102.

With reference to FIGS. 1 through 3, the handle assembly 10 of the present disclosure is coupled to the electrical connector plug assembly 100 to provide a stable and proper grasping structure by which the user can selectively engage and disengage the connector plug assembly from the corresponding electrical connector. More particularly, the handle assembly 10 includes arm member 12, and gripping assembly 14. The handle assembly is coupled to the connector plug assembly through the arm member 12.

Figure 10:
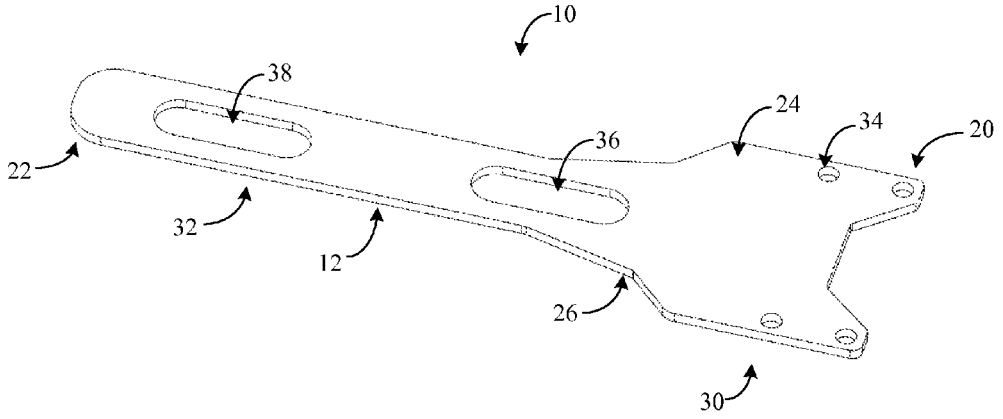
FIG. 10 of the drawings is a perspective view of the arm member of the handle assembly of the present disclosure.

Referring now to FIG. 10, the arm member 12 includes first end 20, second end 22, top surface 24, and bottom surface 26. Preferably, the arm member comprises substantially flat metal stock which can be formed or otherwise cut and/or shaped to the proper dimensions. Thus, the arm member 12 is substantially planar. The arm member 12 includes a plug engagement structure 30 and a gripper engagement structure. The plug engagement structure includes openings 34, which match up with the openings on the central body of the lever arm engaging plate as well as the corresponding coupling bores of the housing 102. Thus, the two can be secured together and to the housing simultaneously. The arm member 12 extends in a direction away from the housing.

It will be understood that in certain embodiments, the lever arm engaging plate and the arm member may be combined into a single integrally formed member. For example, the plug engagement structure of the arm member can be enlarged and the first and second side spaced apart fingers can be formed at either side of the arm member, in place of the lever arm engaging plate. In other embodiments, the two plates may be coupled together (i.e., adhered, riveted, or otherwise fastened) so as to form a subassembly which can then be coupled to the housing 102. It is contemplated that the lever arm may comprise a metal member, although, polymer and composite materials are likewise contemplated for use.

Figure 15:
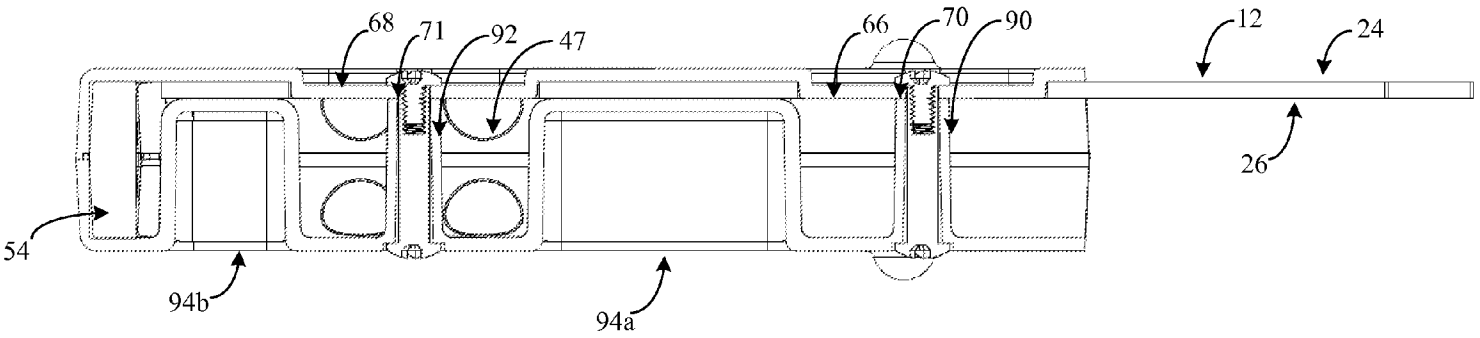
FIG. 15 of the drawings is a cross-sectional view of an electrical connector plug assembly having a handle assembly of the present disclosure, taken generally about lines 15-15 of FIG. 2.
Figure 16:
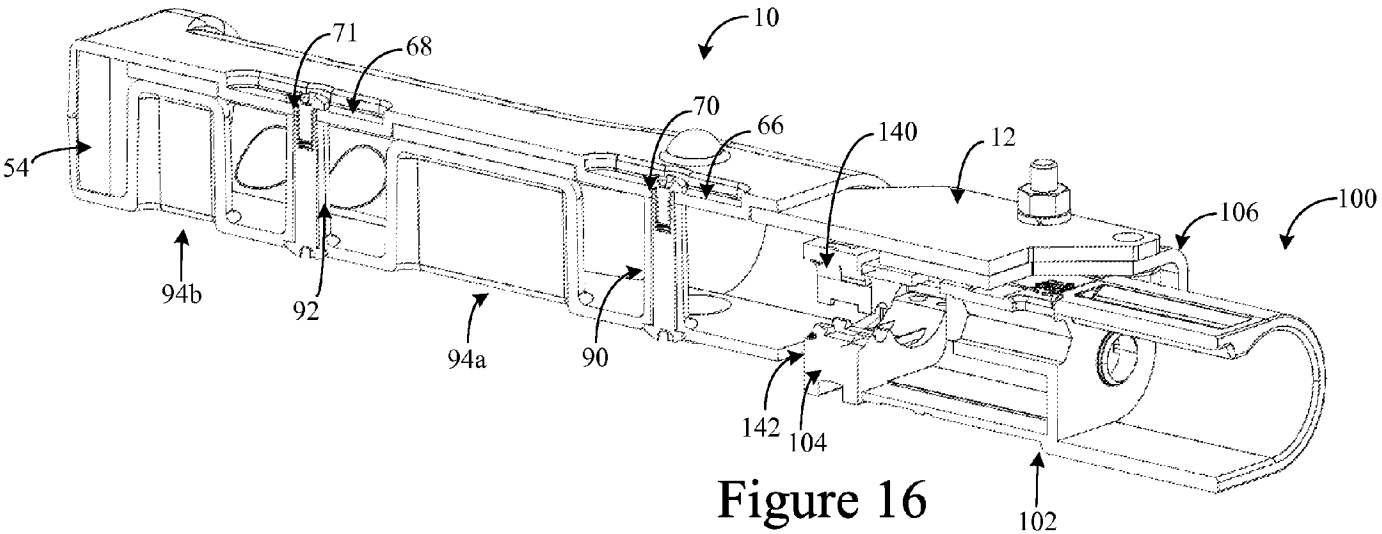
FIG. 16 of the drawings is a perspective view of the cross-sectional view shown in FIG. 15 of the electrical plug assembly having a handle assembly of the present disclosure.
Figure 17:
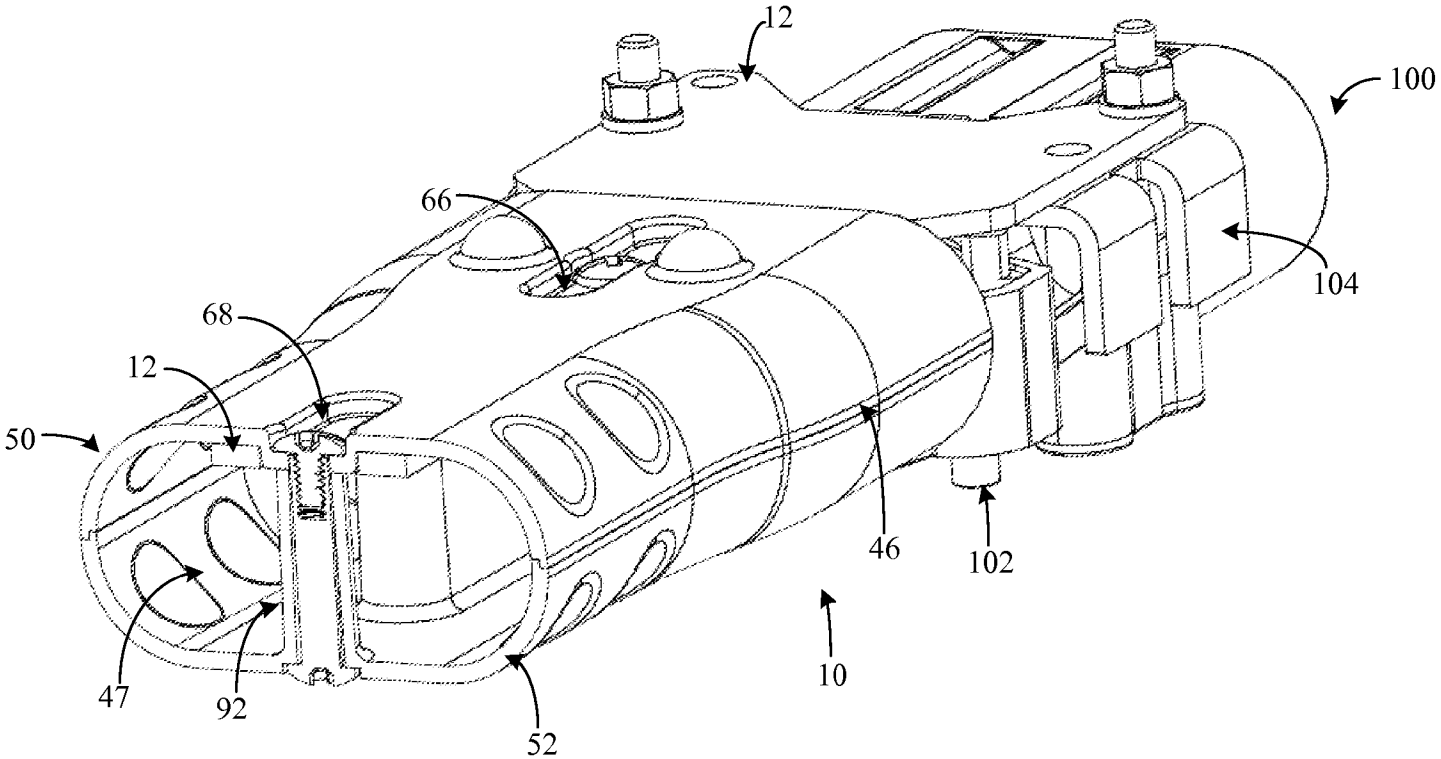
FIG. 17 of the drawings is a perspective cross-sectional view of an electrical connector plug assembly having a handle assembly of the present disclosure, taken generally about lines 17-17 of FIG. 2.

With reference to FIGS. 15 through 17, the gripper engagement structure 32 extends proximate the second end 22 of the arm member and includes proximal slot portion 36 and distal slot portion 38. The overall shape of the gripper engagement structure is such that it may fit within the enclosure 47 defined by the gripping assembly 14. In the configuration shown, the proximal and distal slots are elongated in the longitudinal direction, although other configurations are contemplated. In addition, while oval-like members are shown, other configurations of the slot portions are contemplated, without limitation.

With reference to FIGS. 11 through 14, the gripping assembly 14 is formed from an upper gripping portion 50 and a lower gripping portion 52, and distal end gasket 54. The gripping assembly includes first end 40, second end 42, outer surface 44 and a seam 46 extending along the mating between the upper gripping portion 50 and the lower gripping portion 52. The griping assembly defines an enclosure through which the conductors extend from the electrical connector plug assembly, defining a first opening at the first end and a second opening at the second end for receiving the conductors extending therethrough.

The outer surface defines a generally rectangular cross-section with rounded shorter sides and sized so as to allow for grasping thereof by the palm and hand of a user. In the configuration shown, the body of the gripping assembly narrows between the first end and the second end so as to provide for an improved grasping by a user toward the second end which is narrower than the first end and the housing 102. The gripping assembly may include various features to provide enhanced tactile feel for a user, with the understanding that the upper and lower gripping portions comprise a polymer member. It is also contemplated that the gripping assembly may be formed from a metal material, partially, or entirely. The disclosure is not limited to any particular material from which the gripping assembly is utilized.

Figure 11:
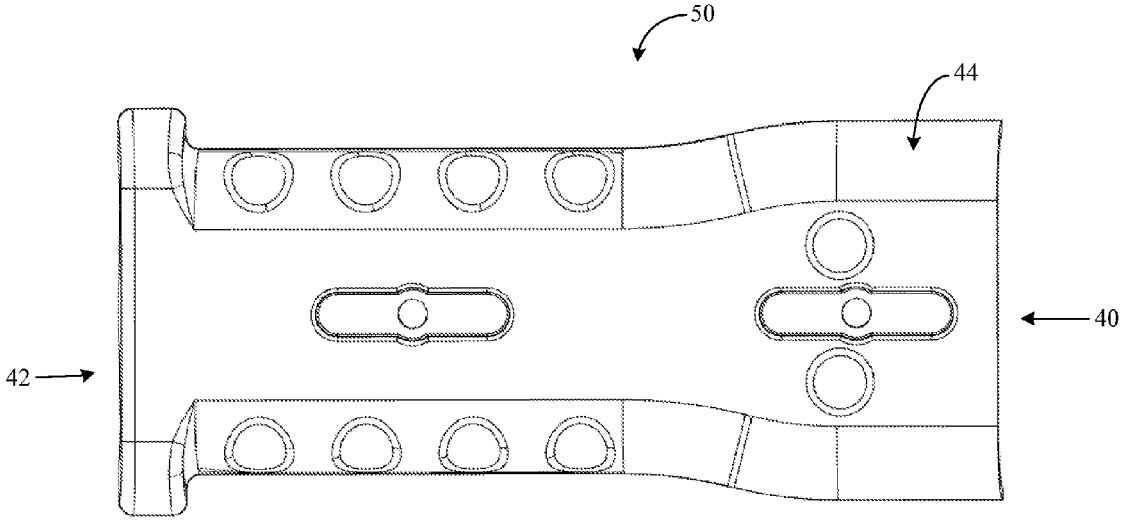
FIG. 11 of the drawings is a top plan view of the upper gripping portion of the gripping assembly of the handle assembly of the present disclosure.
Figure 12:
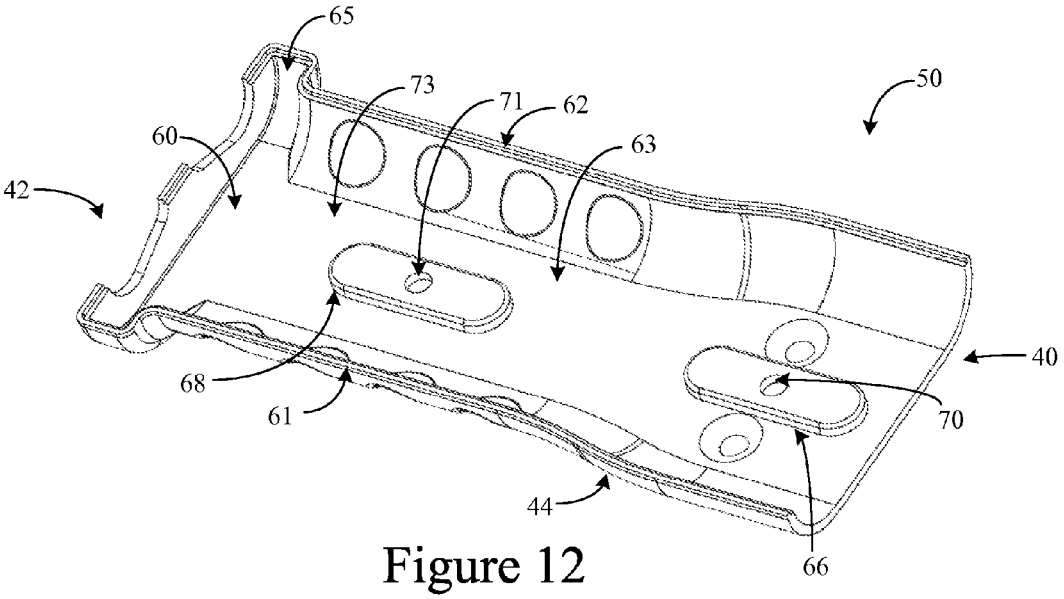
FIG. 12 of the drawings is a perspective view of the upper gripping portion of the gripping assembly of the handle assembly of the present disclosure, showing, in particular, the inner surface thereof.

The upper gripping portion 50 is shown in greater detail in FIGS. 11 and 12 as comprising inner surface 60, which includes base portion 63, first sidewall portion 61 and second sidewall portion 62. The inner surface defines elongated channel 73. The base portion is configured to engage the top surface 24 of the arm member 12. The base portion includes proximal protruding tab 66 having an opening 70 extending therethrough, and distal protruding tab 68 having an opening 71 extending therethrough. It will be understood that the opening may be recessed on the outer surface of the upper gripping portion so that the fastener lies below the grasping surface.

A transverse slot portion 65 is positioned at the second end of the upper gripping portion. As will be explained, the transverse slot portion is configured to receive the distal end gasket 54.

Figure 13:
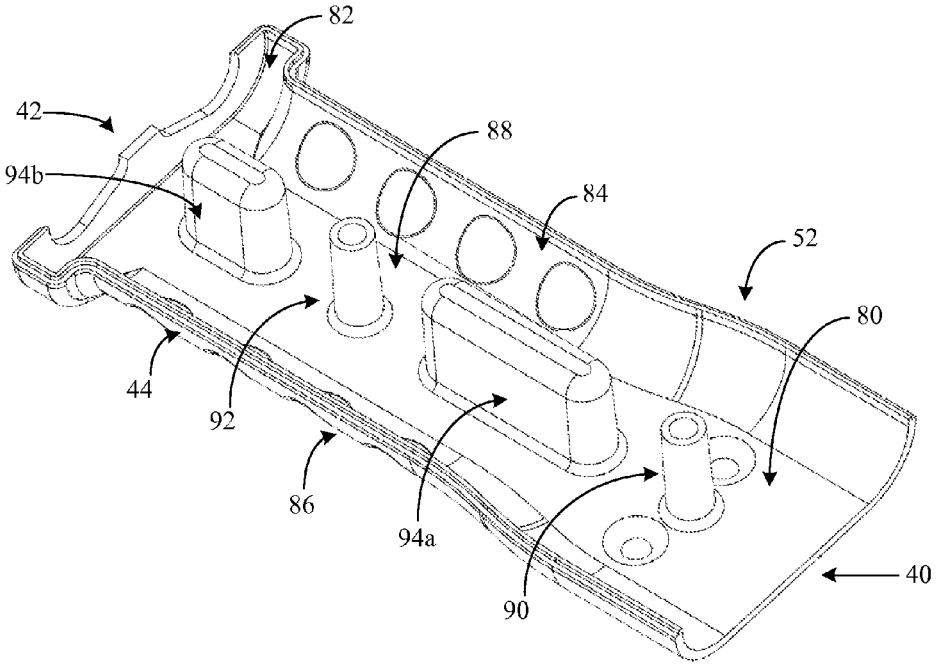
FIG. 13 of the drawings is a perspective view of the lower gripping portion of the gripping assembly of the handle assembly of the present disclosure, showing, in particular, the inner surface thereof.

With reference to FIG. 13, the lower gripping portion 52 matches up with the upper gripping portion and includes inner surface 80, first sidewall portion 84 and second sidewall portion 86. As with the upper gripping portion 50, the lower gripping portion 52 defines an elongated channel. The base portion includes proximal elongated bore 90 that extends away from the inner surface 80 in a generally perpendicular manner. Similarly, spaced apart therefrom is distal elongated bore 92 which likewise extends away from the inner surface 80 in a generally perpendicular manner. The position of the elongated bores 90, 92 matches that of the openings 70, 71 of the upper gripping portion 50. Between the openings, or on opposing sides of the openings, are spacer tabs, such as spacer tabs 94*a*, 94*b*.

With reference to FIGS. 15 through 17, when the upper and lower gripping portions are mated, the arm member is sandwiched between the spacer tabs 94*a*, 94*b* and the inner surface of the upper gripping portion 50, with the proximal and distal protruding tabs extending through the proximal and distal slot portions 36, 38 of the gripper engagement structure 32. A fastener is extended through the openings 70, 71 and through proximal and distal elongated bores 90, 92 so as to fasten the upper and lower gripping portions together. In the configuration shown, threaded fasteners are utilized. As the shape of the slot portions and the tabs substantially matches, the arm member is generally precluded from movement relative to the gripping assembly. The gripping assembly has a thickness that generally corresponds to the body of the connector plug assembly.

The distal end gasket 54 includes outer surface 72, inner surface 74, outer edge 76 and conductor openings 78*a*, 78*b*. The distal end gasket 54 extends in the transverse slot portions 65, 82 of the upper and lower gripping portions, respectively. In the embodiment shown, the distal end gasket comprises a flexible material, such as a polymer based material. Additionally, the distal end gasket generally precludes access to the enclosure 47. To install the conductors through the conductor openings 78*a*, 78*b*, slits extend from the conductor openings to the outer edge 76 of the distal end gasket. In the configuration shown, the slits generally mirror the seam 46 between the upper and lower gripping portions.

Advantageously, the user is electrically isolated from each of the conductor and any conductive elements. For example, the conductor extends through the gripping assembly 14 spaced apart from the upper and lower gripping portions, extending between the bottom surface of the arm member and the base portion of the inner surface of the lower gripping portion. The conductor contacts the distal end gasket which is an insulative member. In addition, the fasteners that extend through the openings and bores of the upper and lower gripping portions are electrically isolated from the arm member. Thus, in the event that the arm member is energized, the user is nevertheless isolated therefrom.

It will further be understood that the handle assembly 10 of the present disclosure can be retrofit installed on an existing electrical connector plug assembly 100. For example, the fasteners that retain the lever arm engaging plate 106 to the housing 102 can be removed. Next, the arm member can be installed over the lever arm engaging plate and the fasteners can be used to couple both structures to the underlying housing 102.

Once the arm member is attached to the connector plug assembly 100, the gripping assembly can be assembled around the arm member. In particular, the upper gripping portion is positioned to overlie the top surface of the arm member. The proximal protruding tab 66 extends into the proximal slot portion 36 of the gripper engagement structure 32 of the arm member. At the same time, the distal protruding tab 68 extends into the distal slot portion 38. The slots and protruding tabs serve to locate the upper gripping portion relative to the arm member.

Next, the conductors are threaded into the conductor openings 78*a*, 78*b* of the distal end gasket, and the distal end gasket is positioned within the transverse slot portion of the upper gripping portion. It will be understood that the fit may be an interference fit within the transverse slot portion, or that an adhesive or sealant may be utilized to maintain the engagement between the components.

Subsequently, the lower gripping portion 52 is provided and positioned into place. That is, the two structures are lined up to form the seam 46. In addition, the distal end gasket 54 is directed into the transverse slot portion 82 of the lower gripping portion. Next, the openings 70, 71 of the upper gripping member are lined up to correspond with the elongated bores 90, 92 of the lower gripping portion. Suitable fasteners are extended through the openings and the bores to fasten the two structures to each other. As the structures are fastened, the spacer tabs 94*a*,94*b* are directed into contact with the bottom surface 26 of the arm member so as to direct the arm member toward the inner surface of the upper gripping portion 50. Continued fastening sandwiches the arm member between the upper gripping portion and the lower gripping portion with the interaction between the protruding tabs and the slot portions limiting any lateral movement therebetween. Advantageously, the conductor inlet and the conductor outlet of the housing, and the first and second end openings of the gripping assembly are generally in parallel planes and lie in such an orientation that between the conductor inlet of the housing and the second end opening of the gripping assembly, the conductor that extends therebetween can be maintained in a substantially straight orientation without substantial bends or creasing of the conductor. Such a configuration, although not required, limits the damage to and enhances the operation of the conductor.

It will further be understood that through a generally reverse procedure, the handle assembly 10 can be removed from the electrical connector plug assembly 100. It will further be understood that the assembly instructions provided are exemplary only. In other assembly procedures, the different components may be coupled together in different manners. For example, the lower gripping portion may be introduced to the arm member prior to the upper gripping portion, and the distal end gasket may be provided and installed in a number of distinct positions and kinds of assembly to achieve the fully assembled configuration. In still other configurations, the two gripping portions can be partially assembled relative to the arm member prior to assembly of the distal end gasket.

Figure 18:
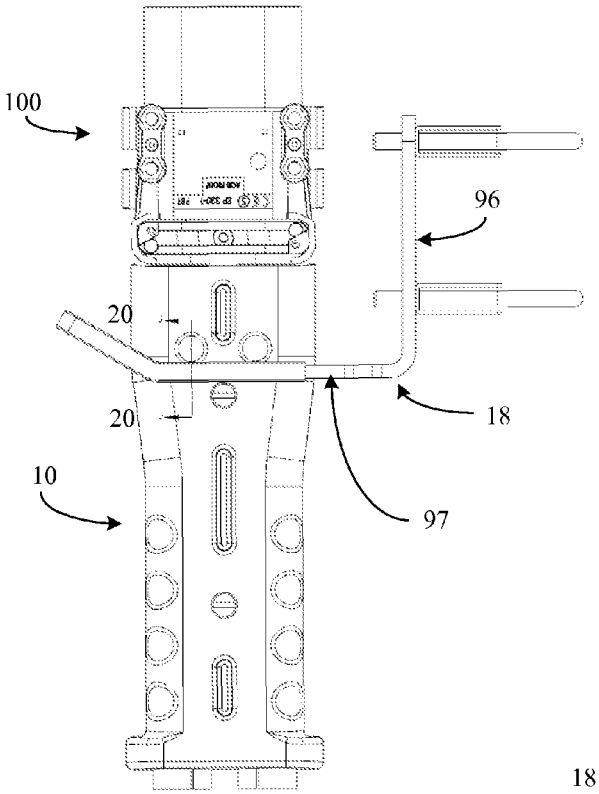
FIG. 18 of the drawings is a side elevational view of the electrical connector plug assembly and the handle assembly in an operational configuration releasably coupled to an outside hanger bracket.
Figure 19:
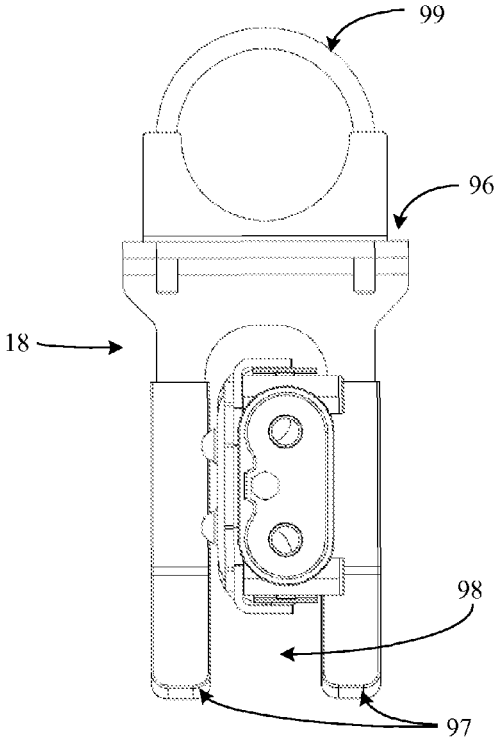
FIG. 19 of the drawings is a top plan view of the electrical connector plug assembly and the handle assembly in an operational configuration releasably coupled to an outside hanger bracket.
Figure 20:
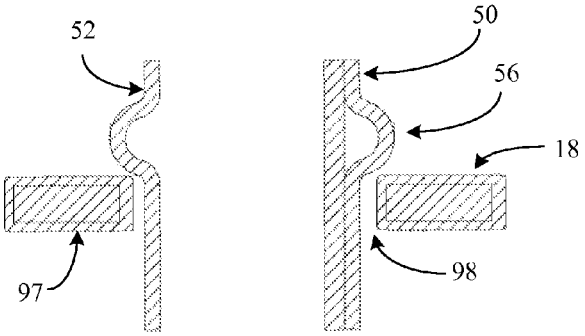
FIG. 20 of the drawings is a partial cross-sectional view of the electrical connector plug assembly and the handle assembly in an operational configuration releasably coupled to an outside hanger bracket, showing, in particular, the interface between the nubs and the spaced apart forks of the hanger bracket, taken generally about lines 20-20 of FIG. 18.

With reference to FIGS. 18 through 20, the electrical connector plug assembly and the handle assembly can be stored on hanger bracket 18 when not in use. The hanger bracket 18 includes base 96 with spaced apart forks 97 extending therefrom. In the configuration shown, the spaced apart forks are generally perpendicular to the base 96, and have an inclined distal end. The spaced apart forks cooperate to define an elongated slot therebetween. The base may be coupled to an outside post or the like (not shown) through, for example, clamps 99.

The forks are spaced apart and of a sufficient length that the gripping assembly can be inserted therebetween and wherein, the gripping assembly can be maintained in the desired orientation. In the embodiment shown, the gripping assembly further includes opposing nubs, such as nub 56 extending from each of the outer surface of the upper and lower gripping portions 50, 52. In this manner, the gripping assembly is forced downward by gravity, until the opposing nubs interact with the spaced apart forks. With particular reference to FIG. 20, the nubs extend from the gripping surface and define a width of the gripping assembly that is greater than the width of the slot for the hanger bracket. Thus, the gripping assembly is precluded from further downward movement. In turn, the two structures are maintained in operable engagement.

The foregoing description merely explains and illustrates the invention and the invention is not limited thereto except insofar as the appended claims are so limited, as those skilled in the art who have the disclosure before them will be able to make modifications without departing from the scope of the invention.

What is claimed is:

1. A combination electrical connector plug assembly and handle assembly for the connector plug, the electrical connector plug assembly comprising:

a housing including a proximal end and a distal end, a top surface, a bottom surface and a first and second side, a conductor inlet at the distal end and a conductor outlet at the proximal end configured to receive a conductor extending therethrough; and a lever arm engaging plate coupled to a top surface of the housing, the lever arm engaging plate including a central body and opposing spaced apart fingers that extend over a respective one of the first side and second side; and the handle assembly comprising:

an arm member having a first end and a second end, and defining a plug engagement structure toward a first end and a gripper engagement structure toward the second end, the first end overlying the lever arm engaging plate with the plug engagement structure coupled thereto; and a gripping assembly having a first end and a second end, the gripping assembly including an outer surface and defining an enclosure structurally configured to facilitate the passing of at least one conductor extending from the connector plug, the second end of the arm member extending into the enclosure of the gripping assembly, with the gripper engagement structure engaging an inner surface thereof, with the arm member coupled to the gripping assembly, the gripping assembly defining a first opening at a first end thereof, the first opening substantially corresponding to the inlet of the housing and positioned proximate thereto.

2. The combination of claim 1 wherein the gripping assembly defines a second opening at a second end thereof, with the first and second openings being defined in planes that are substantially parallel to each other, and generally corresponding to each other and to the conductor inlet and the conductor outlet of the housing.

3. A handle assembly for a connector plug comprising:

an arm member having a first end and a second end, and defining a plug engagement structure toward the first end and a gripper engagement structure toward the second end, the plug engagement structure structurally configured to couple to an electrical connector plug assembly; and a gripping assembly having a first end and a second end, the gripping assembly including an outer surface and defining an enclosure structurally configured to facilitate the passing of at least one conductor extending from the connector plug, the second end of the arm member extending into the enclosure of the gripping assembly, with the gripper engagement structure engaging an inner surface thereof, with the arm member coupled to the gripping assembly, wherein the gripping assembly further includes a upper gripping portion and a lower gripping portion which are joined together to define a seam therebetween, with the arm member being coupled to at least one of the lower gripping portion and the upper gripping portion through at least one fastener; and wherein the arm member includes a top surface and a bottom surface, the top surface extending along an inner surface of the upper gripping portion, and being spaced apart from a base portion of the inner surface of the lower gripping portion.

4. The handle assembly of claim 3 wherein the lower gripping portion includes at least one spacing tab extending from the base portion of the inner surface of the lower gripping portion and abutting the bottom surface of the arm member, with the at least one conductor passing between the bottom surface of the arm member and the base portion of the inner surface of the lower gripping portion.

5. The handle assembly of claim 4 wherein the gripper engagement structure comprises a proximal slot portion and a distal slot portion, each spaced apart from the other along the arm member, the inner surface of the upper gripping portion includes a corresponding proximal protruding tab and a distal protruding tab, the proximal protruding tab shape matingly engaging the proximal slot portion and the distal protruding tab shape matingly engaging the distal slot portion to, in turn, locate the arm member relative to the upper gripping portion.

6. The handle assembly of claim 5 wherein the upper gripping portion includes an opening positioned on the proximal protruding tab and an opening positioned on the distal protruding tab, the lower gripping portion including a proximal elongated bore extending from the inner surface, and a distal elongated bore extending from the inner surface, the proximal elongated bore corresponding to the opening positioned on the proximal protruding tab with the distal elongated bore corresponding to the opening positioned on the distal protruding tab upon positioning the upper gripping portion and the lower gripping portion in a joining orientation.

7. The handle assembly of claim 6 wherein the proximal elongated bore extends to the inner surface of the upper gripping portion and the distal elongated bore extends to the inner surface of the upper gripping portion to, in turn, isolate a fastener extending therethrough from access from within the enclosure defined by the upper and lower gripping portions.

8. The handle assembly of claim 7 wherein the upper and lower gripping portions define an enclosure wherein access to the enclosure is provided at a first end and a second end and precluded therebetween.

9. The handle assembly of claim 8 wherein each of the upper gripping portion and the lower gripping portion defining an opening at the second end thereof, and each including a transverse slot portion at the second end thereof, and a distal end gasket spanning the opening and extending in the transverse slot portion of the upper and lower gripping portions, the distal end gasket having at least one conductor opening extending therethrough, configured to receive the conductor passing from the first end through the second end of the gripping assembly.

10. The combination of claim 1 wherein the arm member is of a substantially uniform thickness, and extends generally parallel to the central body of the lever arm engaging plate and the top surface of the housing.

11. A handle assembly for a connector plug comprising:

an arm member having a first end and a second end, and defining a plug engagement structure toward the first end and a gripper engagement structure toward the second end, the plug engagement structure structurally configured to couple to an electrical connector plug assembly; and a gripping assembly having a first end and a second end, the gripping assembly including an outer surface and defining an enclosure structurally configured to facilitate the passing of at least one conductor extending from a connector plug, the second end of the arm member extending into the enclosure of the gripping assembly, with the gripper engagement structure engaging an inner surface thereof, with the arm member coupled to the gripping assembly, wherein the gripping assembly further includes a upper gripping portion and a lower gripping portion which are joined together to define a seam therebetween, with the arm member being coupled to at least one of the lower gripping portion and the upper gripping portion through at least one fastener;

wherein the upper gripping portion includes a first side wall portion and a second side wall portion, each sidewall portion extending between the first end and the second end, and each matingly engaging to form the seam therebetween; and wherein the first and second sidewall portions are spaced apart a greater distance from each other at a first end thereof than at a second end thereof.

12. The handle assembly of claim 11 wherein the upper gripping portion and the lower gripping portion each include an outer surface with each outer surface being a substantial mirror image of the other.

13. The handle assembly of claim 3 wherein the arm member comprises an elongated member having a substantially uniform thickness between the first end and the second end.

14. The handle assembly of claim 13 wherein the plug engagement structure comprises a plurality of openings extending through the arm member proximate the first end thereof.

15. The combination of claim 2 wherein the gripping assembly includes an upper gripping portion and a lower gripping portion which are coupled together, the upper gripping portion extending over and engaging a top surface of the arm member and the lower gripping portion extending over and engaging a bottom surface of the arm member.

16. The combination of claim 2 further including a hanger bracket attachable to an outside surface, the hanger bracket having a base with spaced apart forks extending outwardly therefrom, to, in turn, define a slot therebetween, the gripping assembly including a plurality of nubs extending from an outer surface thereof, to, in turn, interface the spaced apart forks to maintain the gripping assembly and the hanger bracket in releasable engagement.

* * * * *